United States Patent [19]

Magill et al.

[11] 4,000,596

[45] Jan. 4, 1977

[54] WALL PARTITION SYSTEM AND COMPONENTS THEREOF

[76] Inventors: Hugh Magill, No. 1 Goswell Road, Islington, Ontario, Canada; John Alfred Herwynen, Box 364, King City, Ontario, Canada, L0G 1K0

[22] Filed: Aug. 7, 1975

[21] Appl. No.: 602,748

[52] U.S. Cl. ..... 52/481; 52/489; 52/714

[51] Int. Cl.[2] ..... E04B 5/52

[58] Field of Search ..... 52/489, 481, 281, 498, 52/509, 36, 760

[56] References Cited

UNITED STATES PATENTS

| | | | |
|---|---|---|---|
| 3,308,590 | 3/1967 | Ettore et al. | 52/509 X |
| 3,609,933 | 10/1971 | Jahn et al. | 52/481 X |
| 3,732,657 | 5/1973 | Nelsson | 52/481 X |
| 3,732,660 | 5/1973 | Byssing | 52/489 |
| 3,862,530 | 1/1975 | Martine | 52/281 |
| 3,900,996 | 8/1975 | Yohe | 52/489 X |

FOREIGN PATENTS OR APPLICATIONS

| | | | |
|---|---|---|---|
| 392,825 | 10/1965 | Switzerland | 52/511 |

*Primary Examiner*—Price C. Faw, Jr.
*Assistant Examiner*—Carl D. Friedman
*Attorney, Agent, or Firm*—William T. Howell

[57] ABSTRACT

A clip for securing wall panels and the like to frame members is provided which has a substantially flat T-shaped portion. The vertical leg of the T has a pointed tang extending toward the crosspiece and a pair of locating arms extending laterally in parallel substantially normal of the main plane of the vertical leg to bear upon the rear surface of the wall panel. The crosspiece is bent and provided with a plurality of points extending in parallel to the locating arms.

6 Claims, 3 Drawing Figures

WALL PARTITION SYSTEM AND COMPONENTS THEREOF

This invention relates to wall structures and more particularly to partitions employing vertical frame members to which are secured panels.

In present office partition systems and similar arrangements it has been the practice to erect a frame comprising a series of upper and lower members between which are secured, at regular intervals, vertical members. To these vertical members the partitioning panels are secured usually by means of screws. All systems at present known to the inventors employ such arrangements.

These systems have several shortcomings. They have considerable labour content in their erection. The board and frame have to be prepared to receive the screws employed and the screws have to be secured.

And as a corollary the screw heads have to be covered either with a filling or a cover strip at the joint. Both of these expedients again involve materials and labour.

It is accordingly an object of this present invention to provide a clip and a partitioning system which is fast and simple to assemble.

It is another object of the present invention to provide a clip and a partition strip system which employs such a clip which is economical, both with respect to labour and material.

In accordance with these objects, there is provided in this present invention a clip for use in securing wallboard panels or the like having a rear surface and a side wall to a frame member which comprises:

a flat body portion of resilient material having a first end and a second end;

at least one locating arm extending laterally of said body portion from intermediate the length thereof to abut upon the rear surface of said wall panel;

first gripping means projecting from said body portion to engage said frame member, and second gripping means projecting laterally from adjacent said second end of said body portion to secure said clip to said wall panel side wall.

There is further provided in accordance with these aforementioned objects a wall system comprising in combination, a plurality of vertical studs spaced apart at regular intervals, said studs each providing a clip-receiving channel on a corresponding surface, a plurality of wall panels dimensioned to extend the distance between adjacent clip-receiving channels;

said wall panels each having an outer surface and side walls;

at least one clip secured in each side wall;

said clips comprising;

a flat body portion of resilient material, at least one locating arm extending laterally of said body portion from intermediate the length thereof to abut upon the rear surface of said wall panel;

first gripping means projecting from said body portion to engage an adjacent clip-receiving channel, and second gripping means projecting laterally from adjacent said second end of said body portion into said side wall of said wall panel.

The realization of these objects and the advantages of the present invention will be more apparent from the following description and drawings in which.

Figure 1:
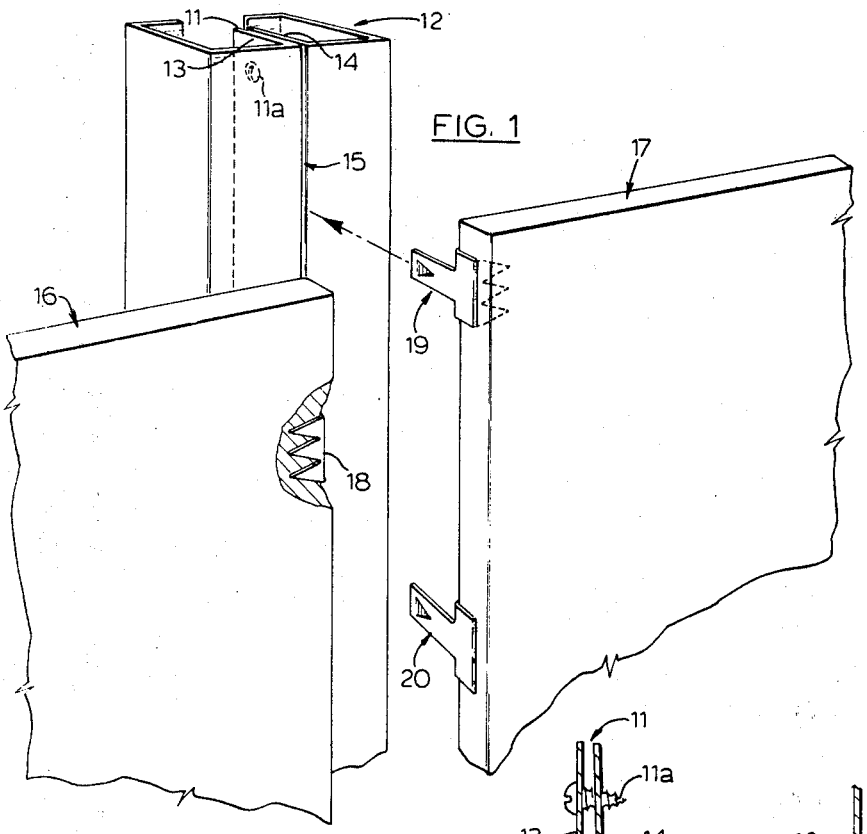
FIG. 1 is a general perspective fragmentary view of a partition system in accordance with the present invention in a partially assembled state.

Referring now to the drawings as illustrated in FIG. 1. A partition system in accordance with the present invention comprises a series of vertical studs arranged or secured along the line of the future wall.

Figure 3:
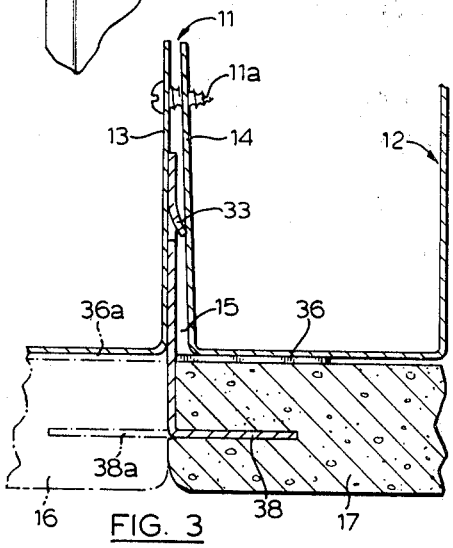
FIG. 3 is a diagrammatic section through a pair of panels and a stud showing the interrelationship of the various components in an assembled wall.

In FIG. 1 the vertical member comprises a pair of steel studs such as 11 and 12 each of which has an inwardly extending juxtaposed wall such as 13 and 14 defining a small channel 15. These studs are secured one to the other by conventional screws such as 11*a*, illustrated in FIG. 3.

The numbers 16 and 17 indicate adjacent members of the future wall and these may be formed from gypsum, plywood or any suitable material.

Figure 2:
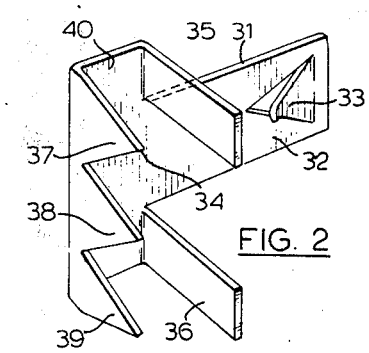
FIG. 2 is an enlarged perspective view of a preferred embodiment of a clip in accordance with the present invention.

At 18, 19 and 20 three clips in accordance with the present invention are illustrated. These clips as shown in FIG. 2, have a substantially T-shaped form with the vertical or main leg being indicated at 31 and the crosspiece being indiated at 40. From the vertical leg 31 a tang 33 extends, as shown, out of the main plane of leg 31 towards the crosspiece 40.

The crosspiece 40 also has a pair of arms, 35 and 36, extending laterally on either side of leg 31 in the manner shown. These arms serve to locate the clip 20 with reference to the wallboard panel. And from the terminal edge of crosspiece 40 points 37, 38 and 39 extend in parallel with arms 35 and 36.

It will be apparent from the structure of clip 40 that it may be formed very simply and cheaply from a single piece of resilient material. However, it will be apparent that alternate geometrics of the component parts may be employed and that one or two of the lateral arms may not always be necessary.

After the studs 11 and 12 have been fixed in position along the length of the future wall, clips such as 19 and 20 are set into the adjacent wall panels as shown, with the arms 35 and 36 seated against the rear wall of the panel. In this manner these arms serve as a guide to the installer so that the points 37, 38 and 39 do not damage the exposed surface of the panel.

After the requisite number of clips have been mounted the clips are then aligned with the gap 15 between the studs 11 and 12 and pushed home. These studs are generally steel or they may be of any suitable material softer than that of the clips. When the clips are pushed home the tang 33 will recede but be biased outwards to engage the adjacent stud surface 14 as shown. The wall panels such as 16 and 17 are thus firmly secured into position.

There will, of course, be a line at the junction of panels 16 and 17 but this is not marred by screw heads or any other fastening means and is not unsightly so that a cover strip is required.

While the foregoing description has described specific embodiments of the clip and wall structure, other possible modifications will be apparent employing the same principles.

We claim:

1. A wall system including a pair of adjacent panels each secured to a frame member by a clip;

each panel having a front surface, a rear surface and a side surface extending between said front and rear surfaces, the side surfaces of the panels being adjacent one another;

each clip having a flat body portion extending partway along the side face of a respective panel from the rear face thereof so as to be spaced from the front face of the panel, said clip body portion being secured to said panel;

each clip also having a leg integral with said body portion and extending beyond the rear face of the panel in a direction perpendicular thereto;

said frame member having a clip-receiving channel into which said clip legs extend in vertically staggered relationship;

each clip leg having a pointed tang projecting therefrom with its point directed generally towards the respective panel; and said channel having opposed walls respectively engaged by each clip leg and pointed tang to retain the panels in assembly with the frame member.

2. A wall system according to claim 1 wherein an element extends integrally and perpendicularly from the body portion of each clip into the side face of the respective panel to secure said body portion to said panel.

3. A wall system according to claim 2 wherein a locating arm extends integrally and perpendicularly from each body portion along the rear face of each panel.

4. A clip for securing a panel to a frame member having a clip-receiving channel;

said clip having a flat body portion with opposite ends;

a locating arm extending integrally from one end of said body portion in a direction perpendicular thereto;

a pointed arm extending integrally from the opposite end of the body portion in a direction perpendicular thereto and on the same side thereof as the locating arm;

a leg extending integrally from said one end of said body portion in the plane thereof and perpendicularly to said locating arm and said pointed arm; and said leg having a pointed tang projecting therefrom with its point directed generally towards the locating arm.

5. A clip according to claim 4 wherein a further locating arm extends integrally from said one end of said body portion in the same direction as the first-mentioned locating arm;

said leg extending from said body portion between said locating arms.

6. A clip according to claim 4 wherein said pointed arm has a serrated free end providing a plurality of points.

* * * * *